US007757887B2

(12) United States Patent
Gardiner

(10) Patent No.: US 7,757,887 B2
(45) **Date of Patent: *Jul. 20, 2010**

(54) BEVERAGE CONTAINER

(75) Inventor: James Lee Gardiner, North Mission Beach (AU)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 271 days.

This patent is subject to a terminal disclaimer.

(21) Appl. No.: 10/813,781

(22) Filed: Mar. 31, 2004

(65) Prior Publication Data

US 2004/0206764 A1 Oct. 21, 2004

Related U.S. Application Data

(63) Continuation of application No. 10/095,203, filed on Mar. 11, 2002, now Pat. No. 6,729,495, which is a continuation of application No. 09/530,927, filed as application No. PCT/AU98/00946 on Nov. 12, 1998, now Pat. No. 6,425,493.

(30) Foreign Application Priority Data

| | | |
|---|---|---|
| Nov. 12, 1997 | (AU) | PP0330 |
| Dec. 9, 1997 | (AU) | PP0804 |
| Mar. 10, 1998 | (AU) | PP2249 |
| Oct. 19, 1998 | (AU) | PP6558 |

(51) Int. Cl.

| | |
|---|---|
| ***B65D 1/16*** | (2006.01) |
| ***B65D 8/00*** | (2006.01) |
| ***B65D 17/00*** | (2006.01) |

(52) U.S. Cl. ..... 220/733; 220/906; 220/729; 220/269

(58) Field of Classification Search ..... 220/269, 220/619, 704, 716, 718, 729, 733, 906
See application file for complete search history.

(56) References Cited

U.S. PATENT DOCUMENTS

| | | | | |
|---|---|---|---|---|
| 1,878,677 | A * | 9/1932 | Curtis | 220/269 |
| 2,812,886 | A | 11/1957 | Weinstein | |
| 3,469,735 | A * | 9/1969 | Burt | 220/698 |
| 3,704,805 | A * | 12/1972 | Sheafe, III | 220/273 |
| 3,874,553 | A | 4/1975 | Schultz et al. | |

(Continued)

FOREIGN PATENT DOCUMENTS

| | | |
|---|---|---|
| DE | 2 318 669 | 11/1974 |

(Continued)

*Primary Examiner*—Anthony Stashick
*Assistant Examiner*—James N Smalley
(74) *Attorney, Agent, or Firm*—Woodcock Washburn LLP

(57) ABSTRACT

A beverage can cap member (16, 100) is configured so that its exterior surface (28) extending radially inwardly from the rim (18) or rim forming portion (140) is substantially flat or continuous, or has a slight curve from a position adjacent from the rim (18) or rim forming portion (140). The cap member (16, 100) may have a countersink (160) which is filled with a filler material including a curable adhesive, an insert (180) of a natural or synthetic material or the like. The filler material increases the structural strength of the cap member (16, 100) to an extent that it can be made of a relatively thinner material and still complies with the minimum peaking pressure of the industrial standard.

31 Claims, 12 Drawing Sheets

U.S. PATENT DOCUMENTS

| | | | | | |
|---|---|---|---|---|---|
| 4,084,525 | A | * | 4/1978 | Booth | 53/408 |
| 4,749,100 | A | * | 6/1988 | Eberhart | 220/792 |
| 4,815,628 | A | * | 3/1989 | Wehnert, III | 220/796 |
| 4,834,258 | A | * | 5/1989 | Root | 220/269 |
| 4,927,048 | A | * | 5/1990 | Howard | 220/716 |
| 4,969,570 | A | * | 11/1990 | Harvey, Sr. | 220/733 |
| 5,119,955 | A | * | 6/1992 | Granofsky | 220/270 |
| 5,131,554 | A | * | 7/1992 | Kuo | 220/258.2 |
| 5,244,111 | A | * | 9/1993 | Merom | 220/694 |
| 5,273,176 | A | * | 12/1993 | Diaz | 220/258.2 |
| 5,285,924 | A | * | 2/1994 | Morris | 220/694 |
| 5,292,022 | A | * | 3/1994 | Blanco | 220/257.1 |
| 5,497,896 | A | | 3/1996 | Shand | 220/906 |
| 5,501,362 | A | | 3/1996 | Cudzik | 220/906 |
| 5,645,190 | A | | 7/1997 | Goldberg | 220/906 |
| 5,647,497 | A | * | 7/1997 | Labbe | 220/257.2 |
| 5,653,355 | A | * | 8/1997 | Tominaga et al. | 220/269 |
| 5,655,678 | A | | 8/1997 | Kobayashi | 220/906 |
| 5,692,633 | A | * | 12/1997 | Gordon | 220/253 |
| 5,715,964 | A | | 2/1998 | Turner et al. | 220/906 |
| 5,813,561 | A | | 9/1998 | Chang et al. | 220/906 |
| 5,934,495 | A | * | 8/1999 | Chiodo | 220/257.2 |
| 5,967,363 | A | | 10/1999 | Allen | 220/733 |
| 5,996,832 | A | * | 12/1999 | Nieuwoudt | 220/257.2 |
| 6,202,880 | B1 | * | 3/2001 | Strube et al. | 220/269 |
| 6,425,493 | B1 | | 7/2002 | Gardiner | |
| 6,719,166 | B2 | * | 4/2004 | Ceolin et al. | 220/783 |

FOREIGN PATENT DOCUMENTS

| | | | | |
|---|---|---|---|---|
| DE | 32 22 894 | | | 1/1984 |
| DE | 195 24 427 | | | 1/1996 |
| EP | 0 165 639 | | | 12/1985 |
| EP | 404734 | A1 | * | 12/1990 |
| JP | 4-3111450 | | | 11/1992 |
| JP | 04311450 | A | * | 11/1992 |
| JP | 06171650 | A | * | 6/1994 |
| JP | 9-058681 | | | 3/1997 |

* cited by examiner

BEVERAGE CONTAINER

CROSS REFERENCE TO RELATED CASES

This application is a continuation of patent application Ser. No. 10/095,203 filed Mar. 11, 2002, now U.S. Pat. No. 6,729,495 which is a continuation of Ser. No. 09/530,927 filed May 8, 2000, now U.S. Pat. No. 6,425,493 which is the 371 of PCT/AU98/00946 filed Nov. 12, 1998, which claims priority to Australian patent application nos. PP0330 filed Nov. 12, 1997, PP0804 filed Dec. 9, 1997, PP2249 filed Mar. 10, 1998, and PP6558 filed Oct. 19, 1998, the entirely of which is incorporated herein by reference.

TECHNICAL FIELD

THIS INVENTION relates to a beverage container having a cap of a suitable material and the cap is configured for easy cleaning; and in particular but not limited thereto the cap is arranged with a ring of countersink adjacent to its peripheral and a filler material is fixed in the countersink so that the cap has a relatively reduced cap material yet is able to withstand normal internal pressure exerted on the cap when the container is filled with a carbonated drink.

BACKGROUND OF THE INVENTION

The applicant has observed that beverage containers, especially aluminium alloy drink cans, have a deep countersink in their caps at a position adjacent to their rims.

As these containers are normally stored in an upright position, foreign materials such as dirt and other undesired matters find their way in the countersinks. Where the containers are kept with foods such as meat or fish in a refrigerator or cooler drips from such foods may fall in the countersinks. As the countersinks are relatively deep the foreign materials therein are not easily noticeable and are difficult to clean.

Further, for containers with beverage pouring apertures in their caps, beverage spillage tends to settle in the countersinks and on other parts of the caps.

Many people drink beverages directly from pour apertures in the caps. Bacteria, germs and diseases in the countersinks can come in contact with the drinkers. Accordingly these containers are not only unhygienic but also a health hazard.

The applicant has also noted that the caps of the beverage cans are normal secured to the can bodies by seaming with or without the assistance of an adhesive. For carbonated drinks the caps must have a minimum thickness in order that the seaming securement is sufficiently strong to prevent separation by internal pressures exerted by the carbonated drinks. This limitation is costly to can manufacturers as the use of thinner materials for the caps is currently not an option.

OBJECT OF THE INVENTION

It is an object of the present invention to alleviate or at least reduce to a certain level one or more of the above prior art disadvantages.

SUMMARY OF THE INVENTION

In one aspect the present invention resides in a beverage container having a hollow body member with opposed ends, a bottom member at one end and a cap member covering an opening at the opposite end thereof. The cap member is sealingly fixed to the body member at said opposite end and in a manner forming a rim at about the periphery of said opposite end. The cap member is configured so that its exterior surface extending radially inwardly from the rim is substantially flat or continuous, or has a slight curvature from a position adjacent to the rim.

In a further aspect therefore the present invention resides in a cap member for covering an open end of a beverage container. The cap member is configured with a rim forming portion at its periphery and so that its exterior surface extending radially inwardly from the rim forming portion is substantially flat or continuous, or has a slight curvature from a position adjacent to the rim forming portion.

It is preferred that the cap member has a substantially ring-shaped countersink at a position adjacent to the rim or rim forming portion and a filler material arranged in the countersink.

The cap member and the body member may be arranged for removably fixing the cap member to the body member.

The removably fixing arrangement may include a thread on said opposite end and a complementary thread on a periphery of the cap member so that the cap member can be threadably fixed to the body member.

The beverage container can be made of any suitable material. Aluminium, aluminium alloy, steel and plastic are examples of the suitable materials. Different components of the container can be made of different ones of the materials. For example the body member can be made of steel and the cap member made of plastic.

Preferably the cap member is configured so that its midpoint is relatively higher than its portion adjacent to the rim or rim forming portion.

The cap member may have one or more ribs or ridges formed on its interior surface and/or exterior surface for improving its structural strength. Other ribs or ridges may also be formed adjacent to a pour aperture in the cap member.

The filler material preferably extends to about the same level as a region of the cap member radially inward therefrom.

Typically the cap member has a scored region and means for assisting separation of the scored region from the rest of the cap member. When the scored region is separated the cap member presents the pouring aperture for dispensing beverage contained in the container.

The assisting means can be a ring-pull tab, a press button or any other suitable means.

One or more parts of the cap member surrounding the pour aperture may be shaped so that any spillage of beverage may flow automatically back into the container through the aperture.

The filler material can be a natural or synthetic material. Desirably it is a material approved by the relevant authority for use in or on a drink container.

The filler material preferably extends to about the same level as a region of the cap member radially inward therefrom.

It is also preferred that the filler material is an adhesive material provided in the countersink and set therein.

In an alternative form the filler material is a ring of rubber or plastic insert element adapted for insertion in the countersink and fixed therein by fixing means.

The fixing means may include an adhesive and/or mechanical deformation of the cap at the countersink or of the filler material.

In one form the mechanical deformation comprises one or wedge portions projecting into the filler material. The or each wedge portion may be arranged to project into one side or opposite sides of the filler material. The wedge portion or portions may also extend laterally or longitudinally or at any angular direction, or in a combination of alternate lateral and/or longitudinal directions and/or angular directions.

In another form the mechanical deformation comprises one or more deformable portions on the filler material and the deformable portion(s) are arranged so that upon insertion of the filler material into the countersink they flow or deform in a manner which in cooperation with the sides of the countersink fixes the filler material therein.

In a further form the mechanical deformation comprises a suction portion formed on the material. The suction portion upon insertion in the countersink fixes to a surface of the countersink and thereby fixes the filler material in the countersink.

The applicant has found that the cap member with a filler material surprisingly increases the peaking pressure (i.e. a pressure at which the cap member fails or separates from the can body) substantially higher than the industrial standard peaking pressure of 620 KPa or 6.32 $Kg/cm^2$ for Aluminium alloy cap member. It follows that a relatively thinner material can be utilised for the cap member and at the same time complying with the industrial requirements. As millions if not billions of beverage containers are consumed each day. The applicant's invention will save the can manufacturers substantial material costs. It will also reduces energy consumption as aluminium alloy manufacturing which uses large amount of energy will have no need to maintain the current production rate.

BRIEF DESCRIPTION OF THE DRAWINGS

In order that the invention can be clearly understood and put into practical effect the invention will now be described in reference to the accompanying drawings which illustrate non-limiting embodiments of the present invention, and wherein.

DETAILED DESCRIPTION OF THE DRAWINGS

Figure 1:
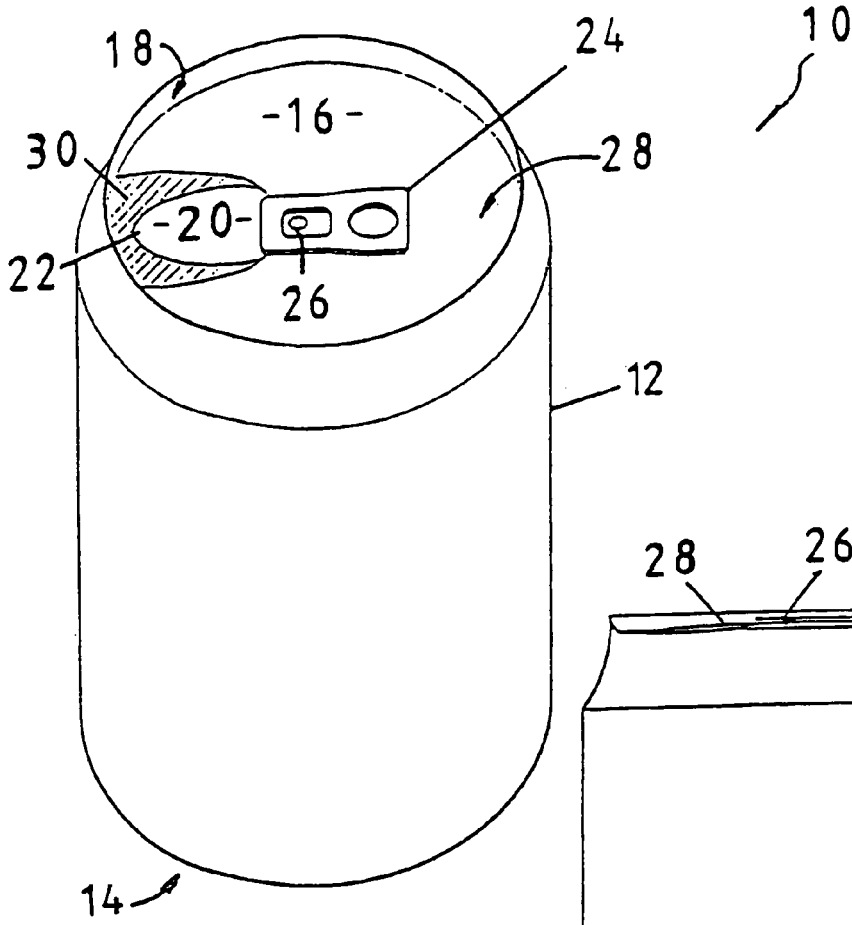
FIG. 1 is a perspective view of a beverage container according to an embodiment of the present invention.
Figure 2:
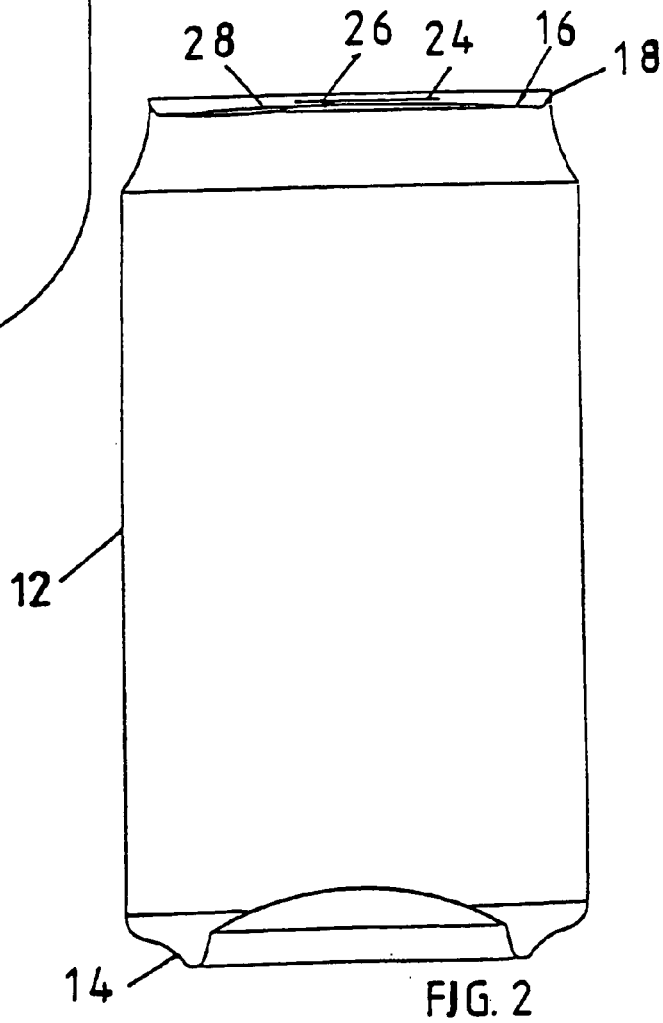
FIG. 2 is a section view of the container shown in FIG. 1.
Figure 3:
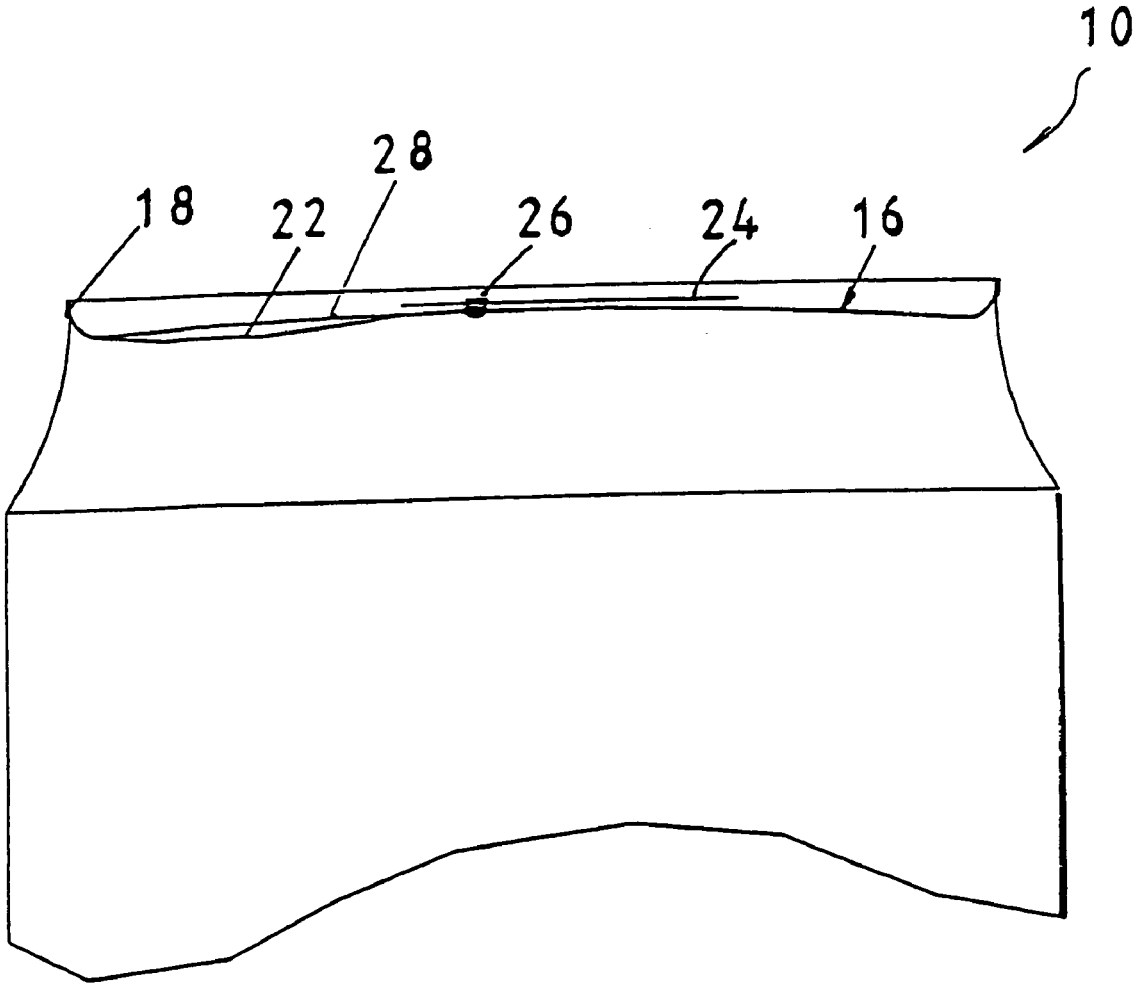
FIG. 3 is an enlarged partial cross sectional view of the container shown in FIG. 1.

Referring initially to FIGS. 1 to 3 there is shown a beverage container 10 which in this case is in the form of an aluminium alloy beverage can for beer, carbonated drink, fruit juice and the like. It should be noted that the container 10 can also be made of steel or plastic.

The can 10 has a tubular body member 12 with a top end and a bottom end. As can be seen in FIG. 2 an end member 14 is formed at the bottom end and a cap member 16 is sealingly fixed to the periphery of the top open end by seaming in this case. A rim 18 is formed at the seam. Alternative the top end may be threaded (not shown) and the cap member 16 may have a complementary threaded periphery (not shown) so that the cap member 16 can be threadably fixed to the top end and easy removal of the cap member 16 from the top end.

While it is not shown it should be understood that a sealing compound can be applied at the seam.

The can 10 as shown is an easy open type. Its cap 16 has a separable portion 20 defined by a score line 22. A ring pull tab 24 fixed to the cap 16 by a rivet 26 is pivotally movable for separating the portion 20 and thereby presenting a pour aperture for dispensing the beverage in the can 10.

FIGS. 2 and 3 clearly show that the exterior surface 28 of the cap 16 has a slightly convex curvature radially inward from the rim 18. Any foreign material on the exterior surface 28 and the portion 20 can be easily noticed and cleaned.

Cleaning the surface 28 and the portion 20 is simply done by a wiping motion with a cleaning cloth or other suitable material for cleaning.

A portion 30 of the cap 16 is shaped to allow spillage of the beverage to flow back into the can 10 through the pour aperture.

As can be seen in FIG. 1 the portion 30 extends from near the rim 18 and around to substantially embrace the portion 20 and to about the tip of the tab portion 24. The portion 30 (see FIGS. 2 and 3) slopes downwardly from the rim 18 to the score line 22.

Figure 4:
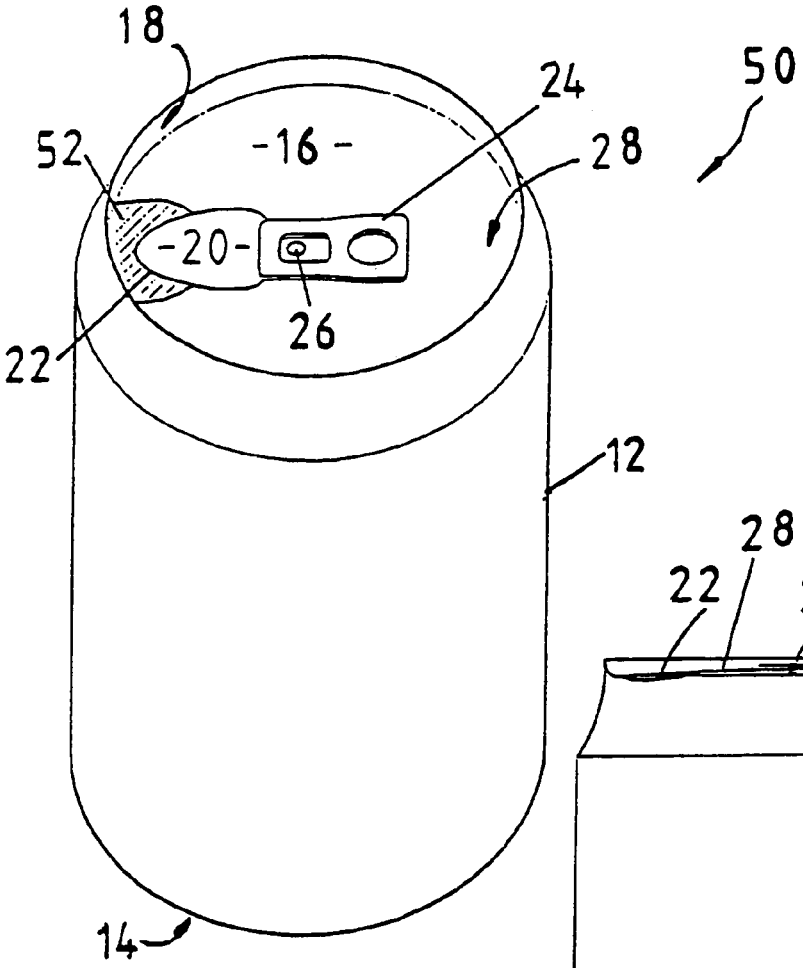
FIG. 4 is a perspective view of a beverage container according to another embodiment of the present invention.
Figure 5:
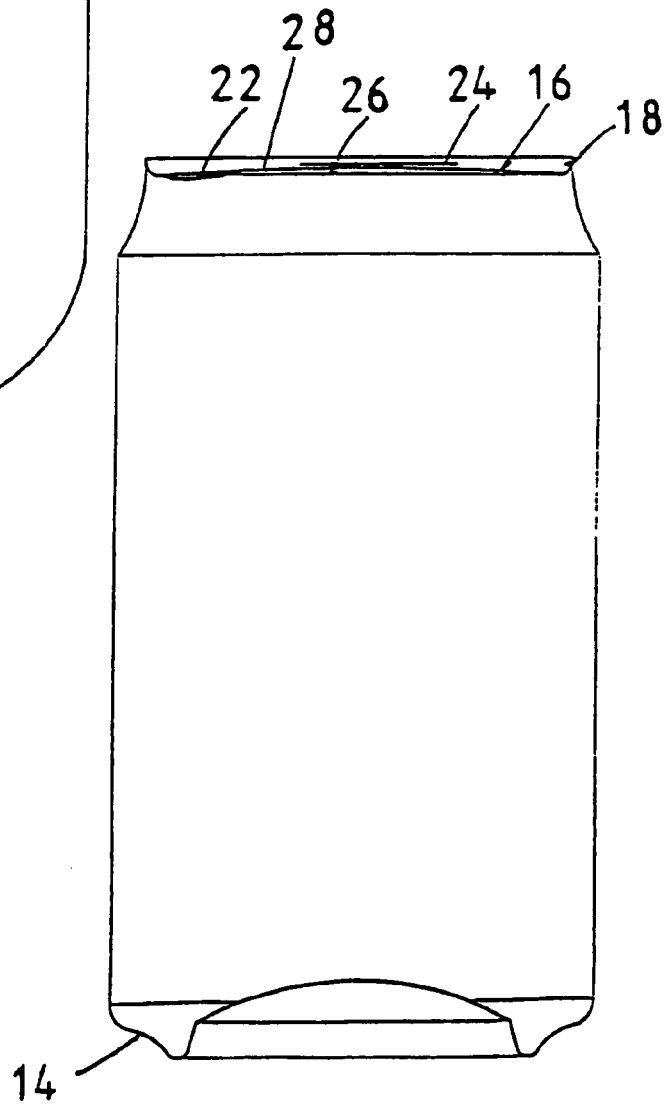
FIG. 5 is a cross sectional view of the container shown in FIG. 4.

FIG. 4 shows another embodiment of a beverage can 50 according to the present invention. The can 50 is substantially similar to the can 10 described with reference to FIGS. 1 to 3 and features which are the same as or similar to those of the can 10 are given the same numeral references.

In this embodiment the shaped portion 52 extends from near the rim 18 to about half way of the separable portion 20.

Ribs or ridges may be formed on the interior surface and/or the exterior surface of cap members 16 of the cans 10, 50 for improving structural strength of the cap members 16 10, 50. One or more other ribs or ridges may also be formed adjacent to the score line 22 for preventing deformation when separating the portion 20.

Figure 7:
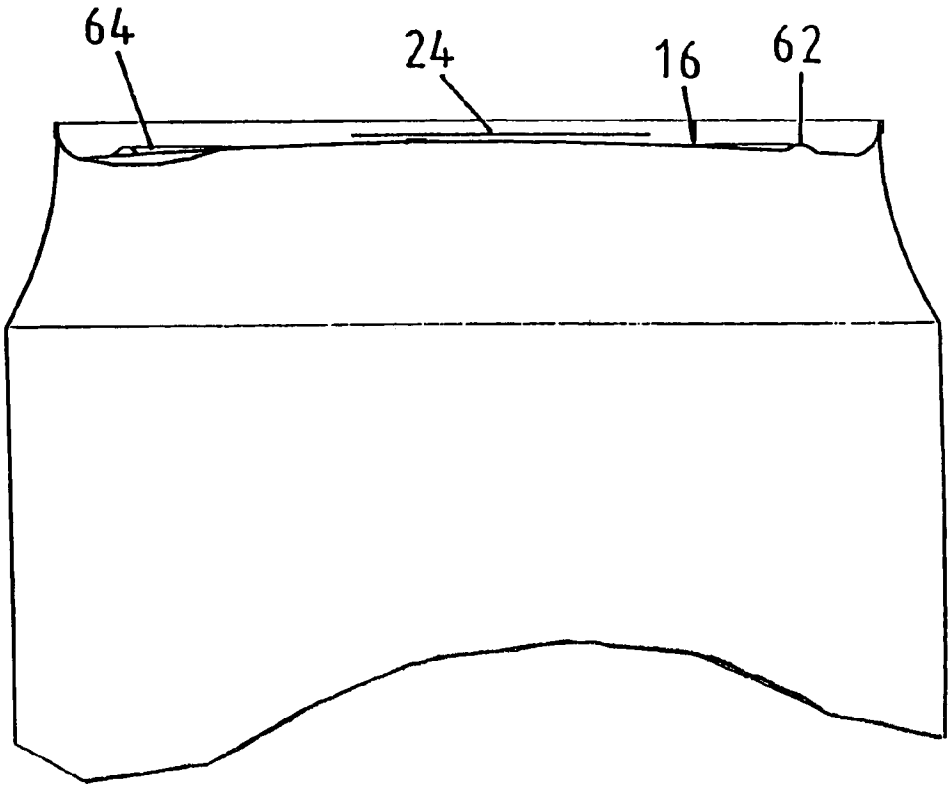
FIG. 7 is an enlarged partial cross-sectional view of the container shown in FIG. 6.
Figure 6:
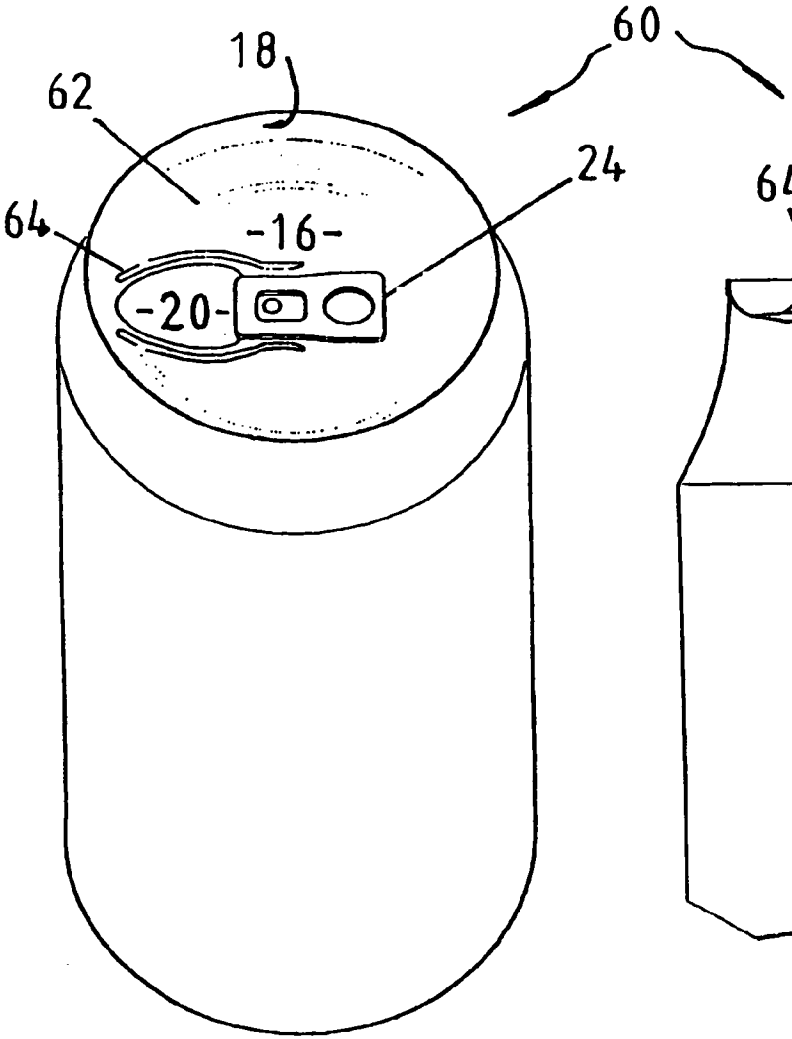
FIG. 6 is a perspective view of a beverage container according to a further embodiment of the present invention.

FIGS. 6 and 7 show a further embodiment 60 of the beverage can according to the present invention. The can 60 is substantially similar to the cans 10 and 50 described earlier except for the configuration of the cap member 16.

The cap member 16 of the can 60 has a rib 62 on the exterior surface thereof. The rib 62 is radially inward of the rim 18 and extends from adjacent to one side of the scored portion 20 and around the tab 24 to adjacent the other side of the portion 20.

The rib 62 joins to spaced further ribs 64 on either side of the portion 20.

As can be seen in FIG. 6 each further rib 64 is spaced from the scored portion 20 and follows substantially the shape of the scored portion 20 at each side thereof.

Figure 9:
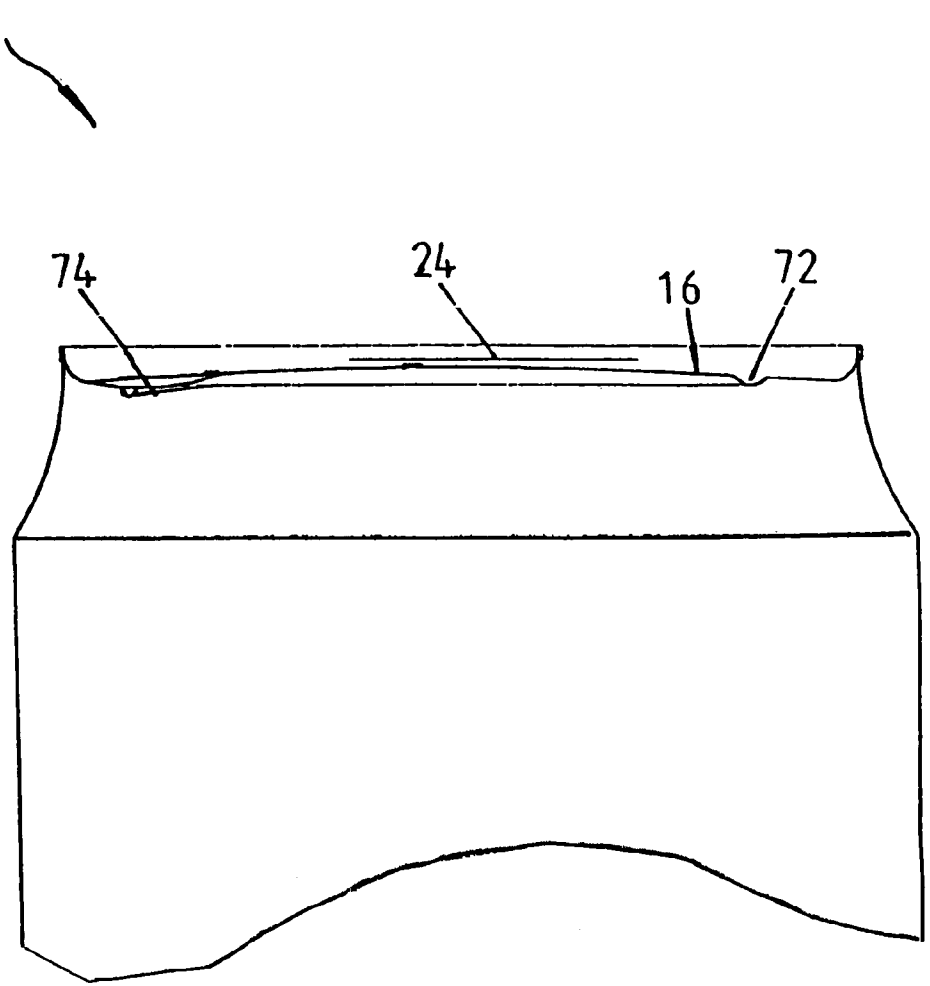
FIG. 9 is an enlarged partial cross-sectional view of the container shown in FIG. 8.
Figure 8:
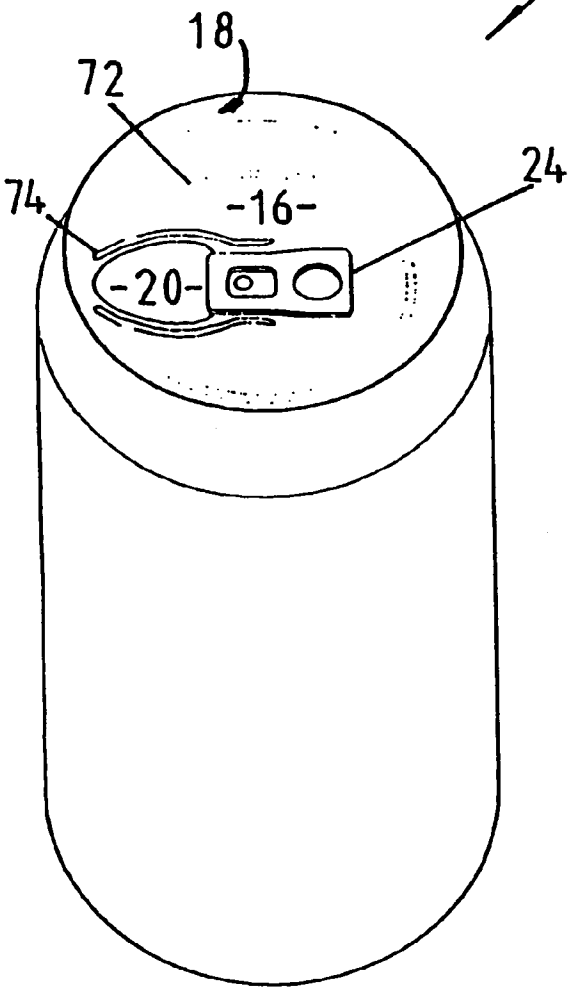
FIG. 8 is a perspective view of a beverage container according to another further embodiment of the present invention.

FIGS. 8 and 9 show another further embodiment 70 of the beverage can according to the present invention. The can 70 in this case is substantially the same as the can 60 shown in FIGS. 6 and 7, except that it has its rib 72 and further ribs 74 on the interior surface of the cap member 16.

It should be noted that the present invention anticipates that a can of the present invention can incorporate both ribs 62 and 72, and further bis 64 and 74 on a single cap member 16. Alternatively, the can may have either rib 62 or rib 72 and either further rib 74 or 64 respectively arranged on the cap member 16.

Figure 10:
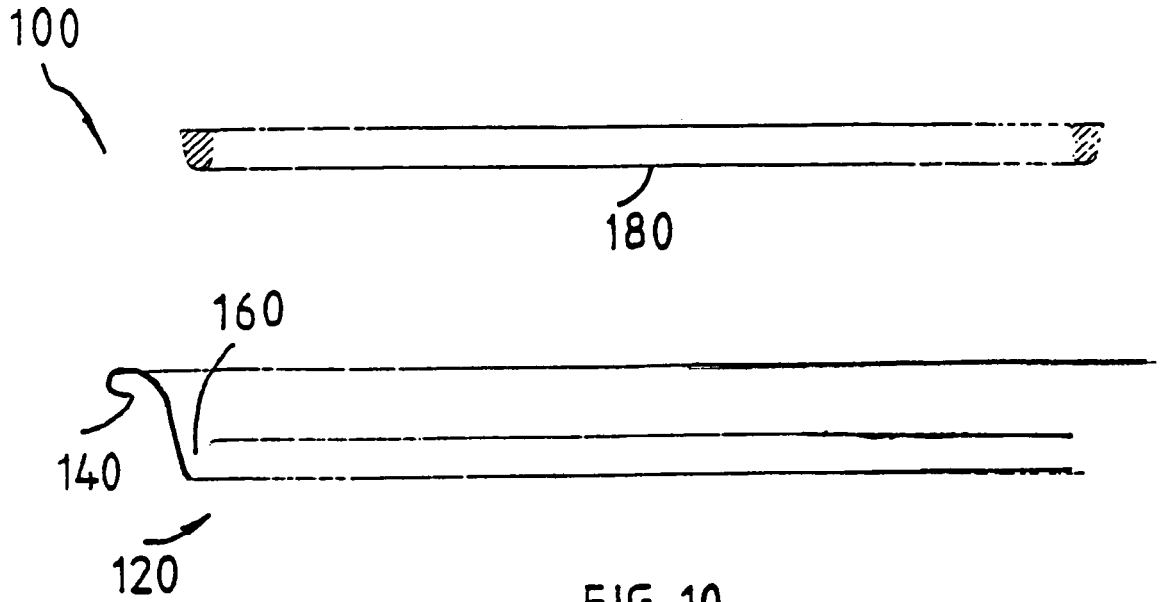
FIG. 10 is a schematic view showing a cap member according to yet another embodiment of the present invention, with a form of the insert element about to be inserted in the countersink.
Figure 11:
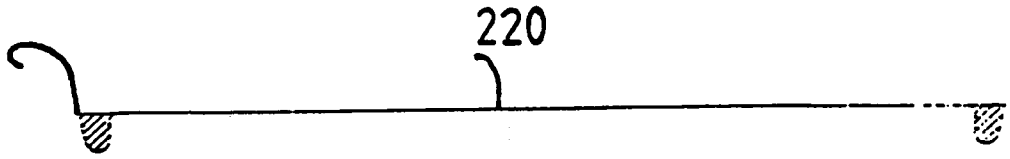
FIG. 11 is a section view of the cap member shown in FIG. 10 with the insert element fully inserted in the countersink.
Figure 12:
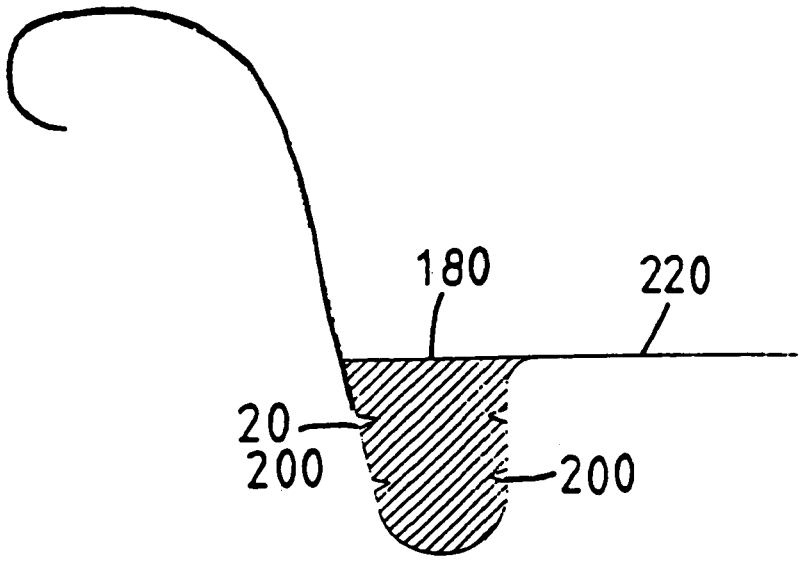
FIG. 12 is a blown-up partial cross sectional view of the cap member shown in FIG. 2.

Referring now to FIGS. 10 to 12 there is shown a cap member 100 for a beverage can (not shown for clarity).

The cap member 100 has a cap body 120 with a peripheral 140 which is shaped to be positioned to position over an open end of a can body and seamed thereat to join to the can body for forming a rim of the can. Adjacent to the peripheral 140 is formed a countersink 160.

An insert element 180 of a plastic material such as PET is inserted in the countersink 160 and fixed therein by wedge portions 200 which in this case are nibs pressed into the insert element 180.

The insert element 180 when fully inserted is substantially level with the radially inner part 220 of the cap 10. The cap 10 can therefore be easily cleaned. It also allows a relatively thinner cap material to be used as it improves the overall strength of the cap 100.

Figure 13:
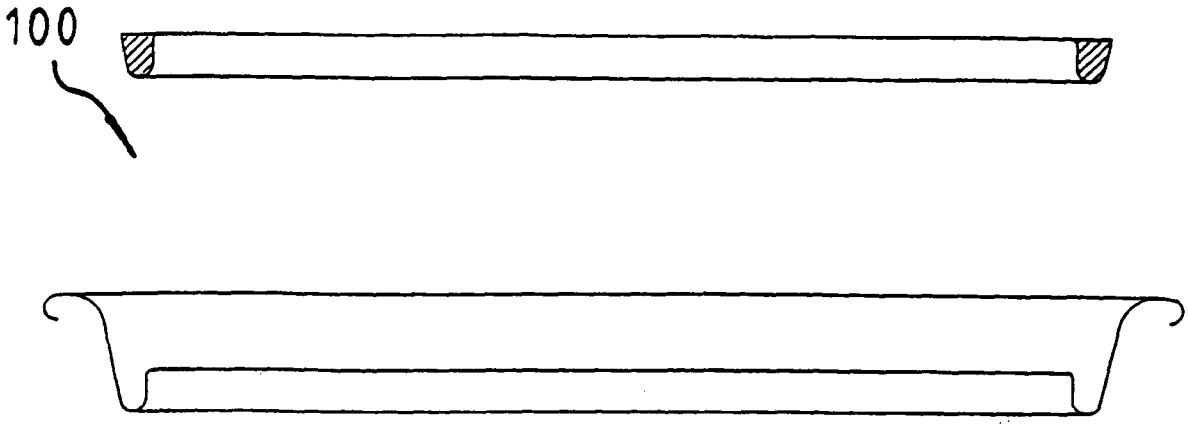
FIGS. 13 to 15 are respectively similar to FIGS. 10 to 12 except for the mechanical deformation arrangement for fixing the insert element.
Figure 14:
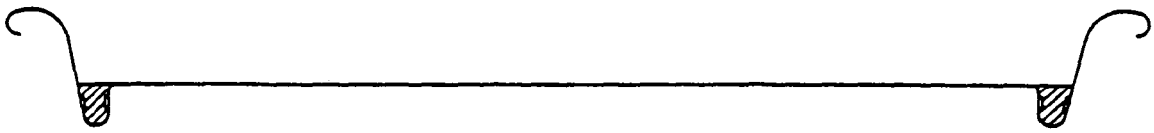
Figure 15:
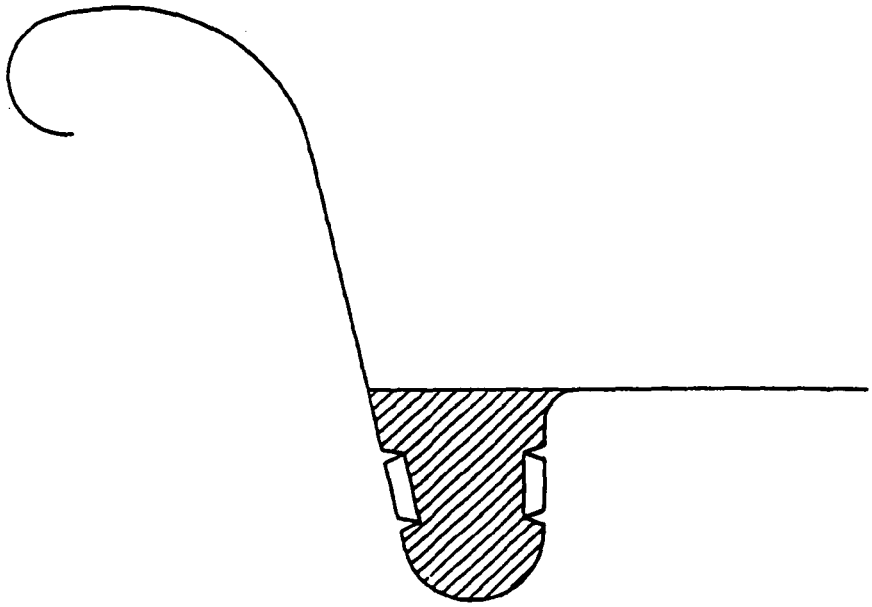

FIG. 13 to 15 show another embodiment of the cap 100 according to the present invention. The only difference from the embodiment shown in FIGS. 10 to 12 is that the wedge portions 200 are now in the form of a combination of alternating laterally directed and longitudinally directed indentions.

Figure 16:
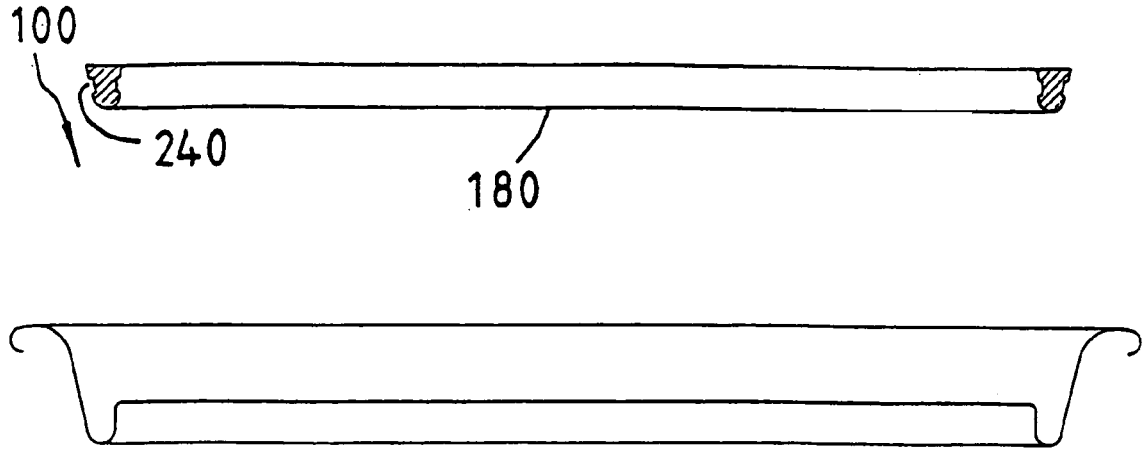
FIGS. 16 to 18 are respectively similar to FIGS. 1 to 3 except for the mechanical deformation arrangement for fixing the insert element.
Figure 17:
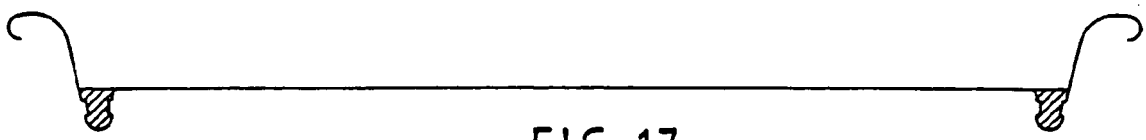
Figure 18:
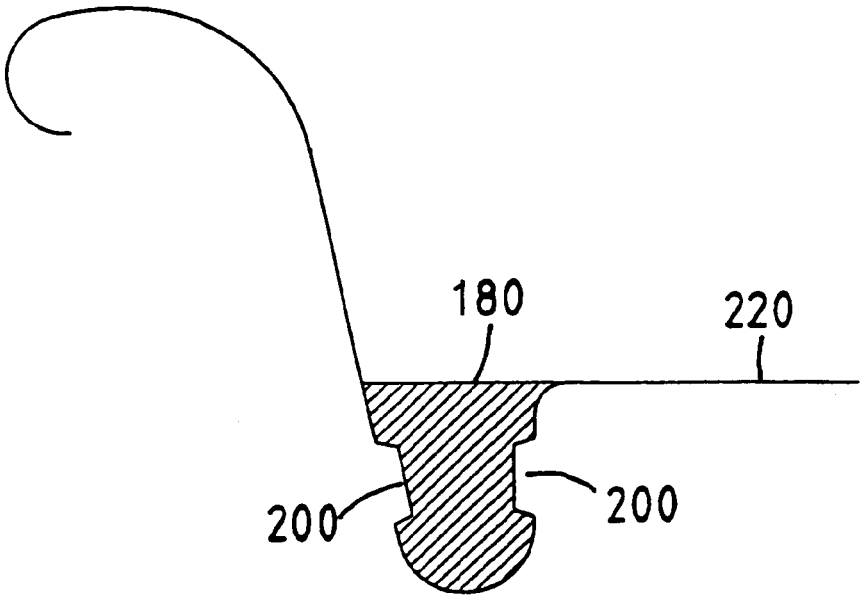

FIGS. 16 to 18 show yet another embodiment of the cap 100 according to the present invention. In this embodiment the insert element 180 has recesses 240 on both its sides and the wedge portions 200 are indentations pressed into the recesses 240.

Figure 19:
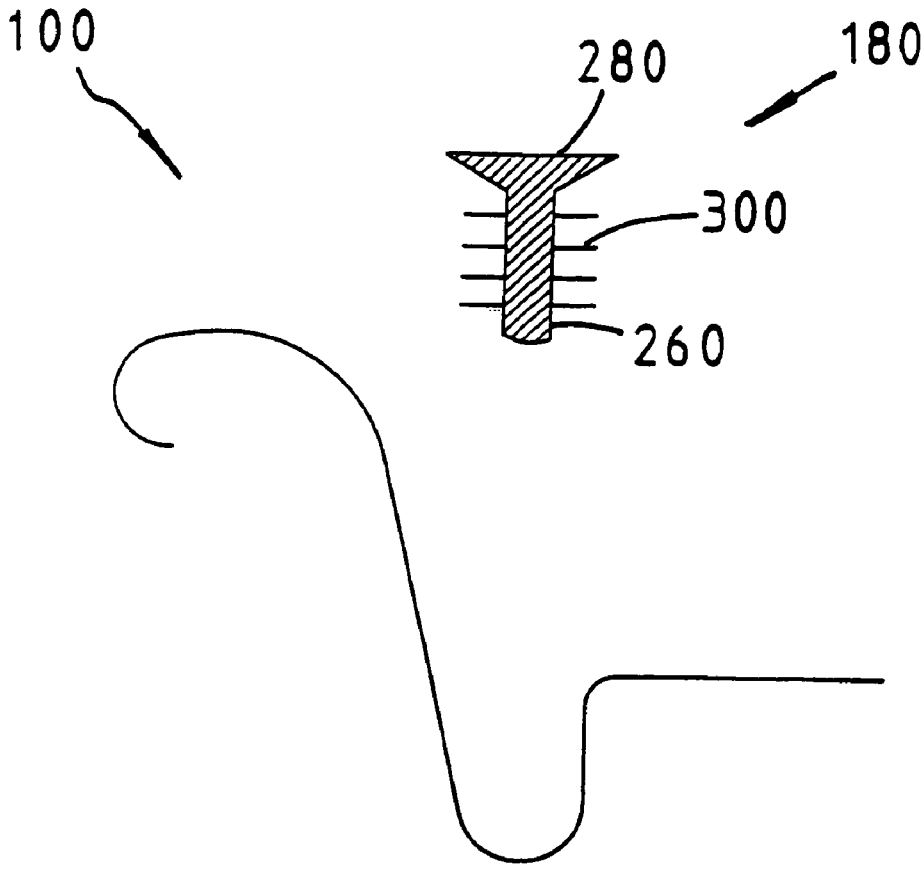
FIG. 19 is a partial schematic cross-section view of another form of a cap member for a beverage container according to the present invention, with a form of the insert element about to be inserted in the countersink.
Figure 20:
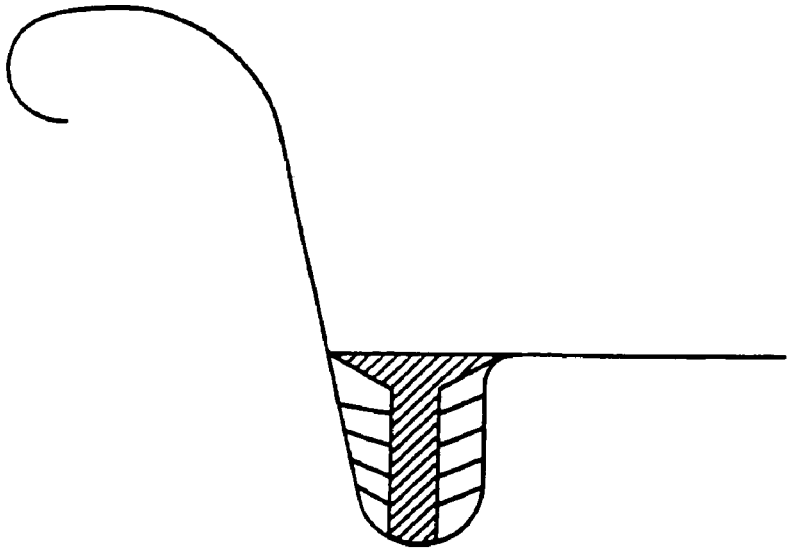
FIG. 20 is a section view of the cap member shown in FIG. 19 with the insert element fully inserted in the countersink.

FIGS. 19 and 20 show an embodiment of the cap 100 according to the present invention. In this embodiment the insert element 180 has a stem position 260, a top portion 280 joined to an end of the stem portion 280 and a number of spaced rings 300 extending around the stem portion 260. In use the rings 300 are deformed upwardly as shown in FIG. 20, when inserting into the countersink 160 and thereby fixing the insert 180 within the countersink 160.

Figure 21:
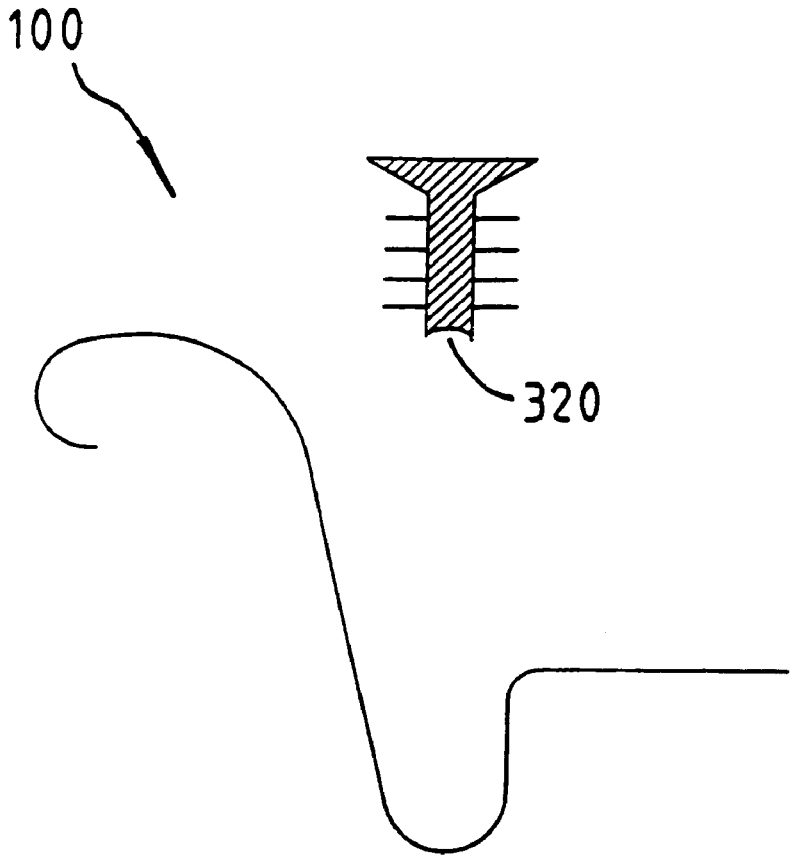
FIG. 21 is a partial schematic cross-section view of a cap member for a beverage container as shown in FIG. 19 except with the addition of a suction portion in the insert element.
Figure 22:
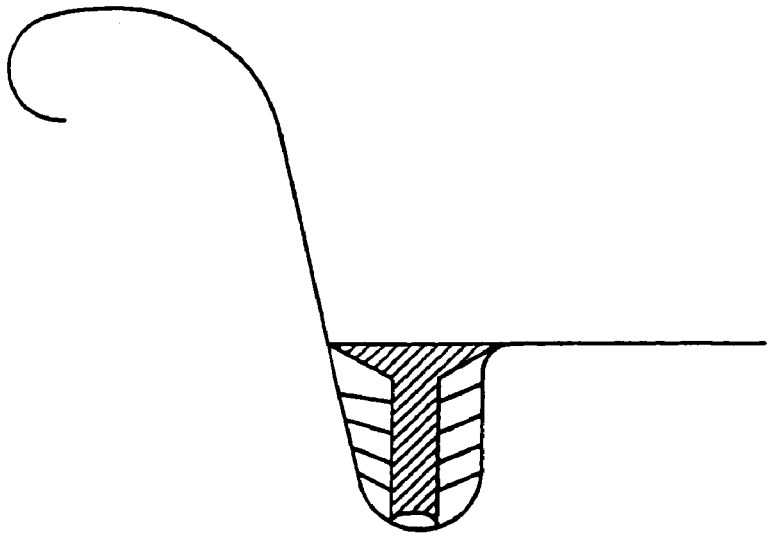
FIG. 22 is a section view of the cap member shown in FIG. 21 with the insert element fully inserted in the countersink.

FIGS. 21 and 22 show another embodiment of the present invention. This embodiment is substantially similar to that shown in FIGS. 19 and 20. In this embodiment the free end of the stem portion 260 has a suction portion 320 which further assists in the fixing of the insert element 180 in the countersink 160.

It should be noted that the cap 100 of the embodiments shown in FIGS. 19 to 22 can have their insert elements 180 inserted in the countersink 16 before or after the cap body 12 is seamed to the can body.

Figure 23:
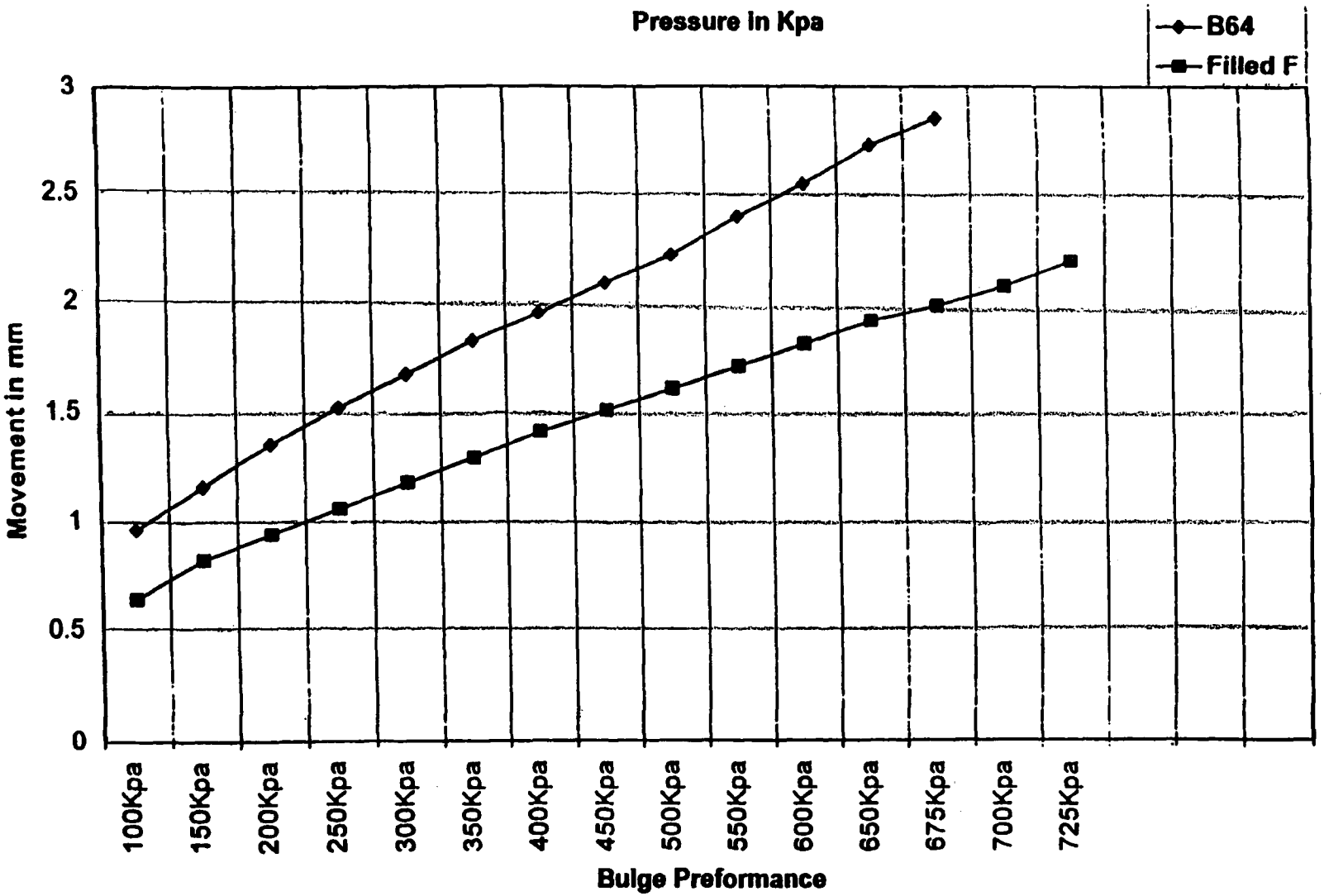
FIG. 23 is a comparison chart showing deformation in the cap members with and without Araldite F as a filler material.

The chart in FIG. 23 shows that an industrial standard B64 alloy beverage can with a cap member of 0.25 mm thickness currently in use in Australia subjecting to 50 KPa incremental internal pressures peaks at 675 KPa. When the countersink in the cap member of the same can is filled with a filler material of 5 part Araldite®F (a Ciba-Geigy product) and 1 part hardener HY2404 (a Ciba-Geigy product), the same test shows that the peaking pressure increases to about 725 KPa. In fact the filled cap member has less deformation throughout the whole range of the test pressures.

Figure 24:
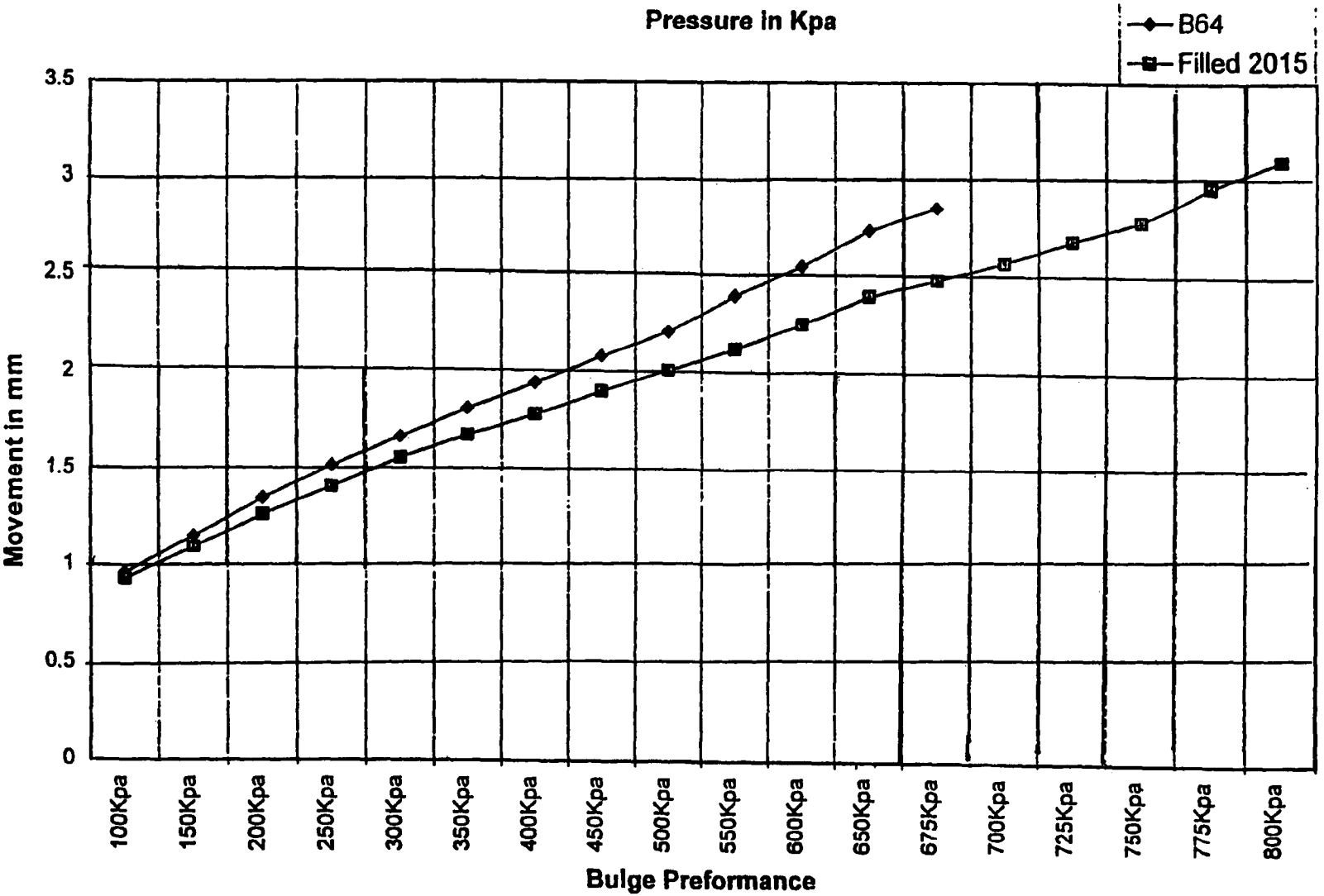
FIG. 24 is a comparison chart showing deformation in the cap members with and without Araldite 2015 as a filler material.

The test for the FIG. 23 comparison is repeated with a filler material represented by Araldite®2015 (a Ciba-Geigy product) which is a mixture of 1 part of AV 5308 adhesive to 1 part of HV 5309-1 hardener. As can be seen in FIG. 24 the peaking pressure increases to about 800 KPa.

The comparison results in FIGS. 23 and 24 support the finding that beverage cans with a thinner grade alloy cap member of the present invention can be used without degrading the peaking pressure requirement of the industry.

Whilst the above has been given by way of illustrative examples of the present invention many variations and modifications thereto will be apparent to those skilled in the art without departing from the broad ambit and scope of the invention as herein set forth.

The invention claimed is:

1. A beverage container comprising:

a hollow body member with opposed ends, a bottom member at one end and a cap member covering an opening at the opposite end thereof, the cap member being sealingly fixed to the body member at said opposite end and in a manner forming a rim at about the periphery of said opposite end, the cap member having:

a circular center panel having a separable portion, and an annular groove located radially outward from the center panel and adjacent to the rim, and a synthetic filler material formed into a ring and suitable for use in or on a drink container (i) covering the groove and (ii) merging with the upper surface of the center panel, where the separable portion of the center panel is uncovered when the filler material is covering the entire groove.

2. The beverage container according to claim 1 wherein the cap member and the body member are arranged for removably fixing the cap member to the body member.

3. The beverage container according to claim 1 wherein the cap member is configured so that its mid-point is relatively higher than its portion adjacent to the rim or rim forming portion.

4. The beverage container according to claim 1 wherein the cap member includes one or more ribs or ridges formed on its interior surface and/or exterior surface for improving its structural strength.

5. The beverage container according to claim 1 wherein the filler material extends to about the same level as the center panel.

6. The beverage container according to claim 1 wherein the cap member has a scored region for forming a pouring aperture for dispensing beverage contained in the container and a pull tab.

7. The beverage container according to claim 6 wherein one or more parts of the cap member surrounding the pour aperture is shaped so that any spillage of beverage may flow automatically back into the container through the aperture.

8. The beverage container according to claim 1 wherein the filler material is an adhesive material provided in the countersink and set therein.

9. The beverage container according to claim 1 wherein the filler material is a ring of rubber or plastic insert element adapted for insertion in the countersink and fixed therein.

10. The beverage container according to claim 9 further comprising an adhesive for fixing the filler material in the groove.

11. The beverage container according to claim 9 further comprising a mechanical deformation for fixing the filler material in the groove, the mechanical deformation comprises one or more wedge portions projecting into one side or opposite sides of the filler material.

12. The beverage container according to claim 11 wherein the wedge portion or portions extends laterally or longitudinally or at any angular direction, or in a combination of alternate lateral and/or longitudinal directions and/or angular directions.

13. The beverage container according to claim 9 further comprising a mechanical deformation for fixing the filler material in the groove, the mechanical deformation comprises one or more deformable portions on the filler material and the deformable portion(s) are arranged so that upon insertion of the filler material into the countersink the deformable potions flow or deform in a manner which in cooperation with the sides of the countersink fixes the filler material therein.

14. The beverage container according to claim 9 further comprising a mechanical deformation that comprises a suction portion formed on the filler material, the suction portion upon insertion in the countersink fixes to a surface of the countersink and thereby fixes the filler material in the countersink.

15. The beverage container according to claim 1 wherein the center panel is configured in a manner so that an exterior surface thereof extending radially inwardly from the countersink is substantially flat or continuous, or has a slight curvature.

16. A cap member for covering an open end of a beverage container having a hollow body member, the cap member comprising:

a peripheral curl for forming a rim;

a circular center panel having a scored region for forming a pour aperture, a pull tab attached to the center panel proximate to the scored region; and an annular groove located radially outwardly from the center panel and adjacent to the peripheral curl, and a synthetic filler material formed into a ring and suitable for use in or on a drink container (i) covering the groove and (ii) merging with the upper surface of the center panel, where the center panel is uncovered when the filler material is covering at least a majority of the groove.

17. The cap member according to claim 16 wherein the filler material extends to about the same level as the center panel.

18. The cap member according to claim 16 wherein one or more parts of the cap member surrounding the pour aperture is shaped so that any spillage of beverage may flow automatically back into the container through the aperture.

19. The cap member according to claim 16 wherein the filler material is an adhesive material.

20. The cap member according to claim 16 wherein the filler material is a ring of rubber or plastic insert element adapted for insertion in the groove and fixed therein.

21. The cap member according to claim 20 further comprising an adhesive for fixing the filler material in the groove.

22. The cap member according to claim 16 wherein the cap includes a mechanical deformation of at least one of the cap and the filler material.

23. The cap member according to claim 22 wherein the mechanical deformation comprises one or more wedge portions projecting into the filler material, each wedge portion projects into at least one side of the filler material.

24. The cap member according to claim 23 wherein each wedge portion projects into opposite sides of the filler material.

25. The cap member according to claim 23 wherein each wedge portion extends laterally or longitudinally or at any angular direction, or in a combination of alternate lateral and/or longitudinal directions and/or angular directions.

26. The cap member according to claim 22 wherein the mechanical deformation includes at least one deformable portion on the filler material and the deformable portion(s) are arranged so that upon insertion of the filler material into the countersink the deformable potions flow or deform in a manner which in cooperation with the sides of the countersink fixes the filler material therein.

27. The cap member according to claim 22 wherein the mechanical deformation comprises a suction portion formed on the filler material, the suction portion upon insertion in the countersink fixes to a surface of the countersink and thereby fixes the filler material in the countersink.

28. The cap member according to claim 16 wherein the center panel is configured in a manner so that an exterior surface thereof extending radially inwardly from the countersink is substantially flat or continuous, or has a slight curvature.

29. The cap member according to claim 16 wherein the center panel comprises a separable portion defined by a score line and at least a portion of the center panel including the separable portion is uncovered when the filler material is covering the entire groove.

30. A beverage container comprising:

a cylindrical body;

an enclosed bottom at an end of the body; and a cap member covering an opening at an opposite end of the body, the cap member being affixed to the body by a peripheral seam; the cap member having:

a circular center panel having a separable portion, and a circumferential recess located radially outward from the center panel, and a synthetic filler material suitable for use in or on a drink container (i) covering at least a portion of the recess that is proximate to the separable portion of the center panel and (ii) merging with an upper surface of the center panel, wherein at least a portion of the separable portion of the center panel is uncovered when the filler material is covering the portion of the recess that is proximate to the separable portion.

31. The beverage container according to claim 30 wherein the separable portion is uncovered when the filler material is the entire recess.

* * * * *